United States Patent [19]

Pérez

[11] 4,230,134

[45] Oct. 28, 1980

[54] INSTRUMENT FOR USE IN HAIR CUTTING

[76] Inventor: Edwin C. Pérez, R.F.D. 2 Buzon 198, Carretera 175, Rio Piedras, P.R. 00928

[21] Appl. No.: 928,277

[22] Filed: Jul. 31, 1978

[51] Int. Cl.[3] ..... A45D 24/36

[52] U.S. Cl. ..... 132/45 R

[58] Field of Search ..... 132/45 R, 205, 149

[56] References Cited

U.S. PATENT DOCUMENTS

| | | | |
|---|---|---|---|
| 181,904 | 9/1876 | Bow et al. | 132/45 R |
| 1,853,828 | 4/1932 | Mani | 132/45 R |
| 2,562,421 | 7/1951 | Hendra | 132/45 R X |
| 2,604,101 | 7/1952 | Helfgott | 132/45 R |

*Primary Examiner*—G. E. McNeill

*Attorney, Agent, or Firm*—Scrivener, Parker, Scrivener and Clarke

[57] ABSTRACT

The disclosure is of a device used in a hair cutting procedure, comprising a pair of comb-like parts having alternately positioned teeth which may be moved into and out of engagement to alternately hold and release the hair.

3 Claims, 3 Drawing Figures

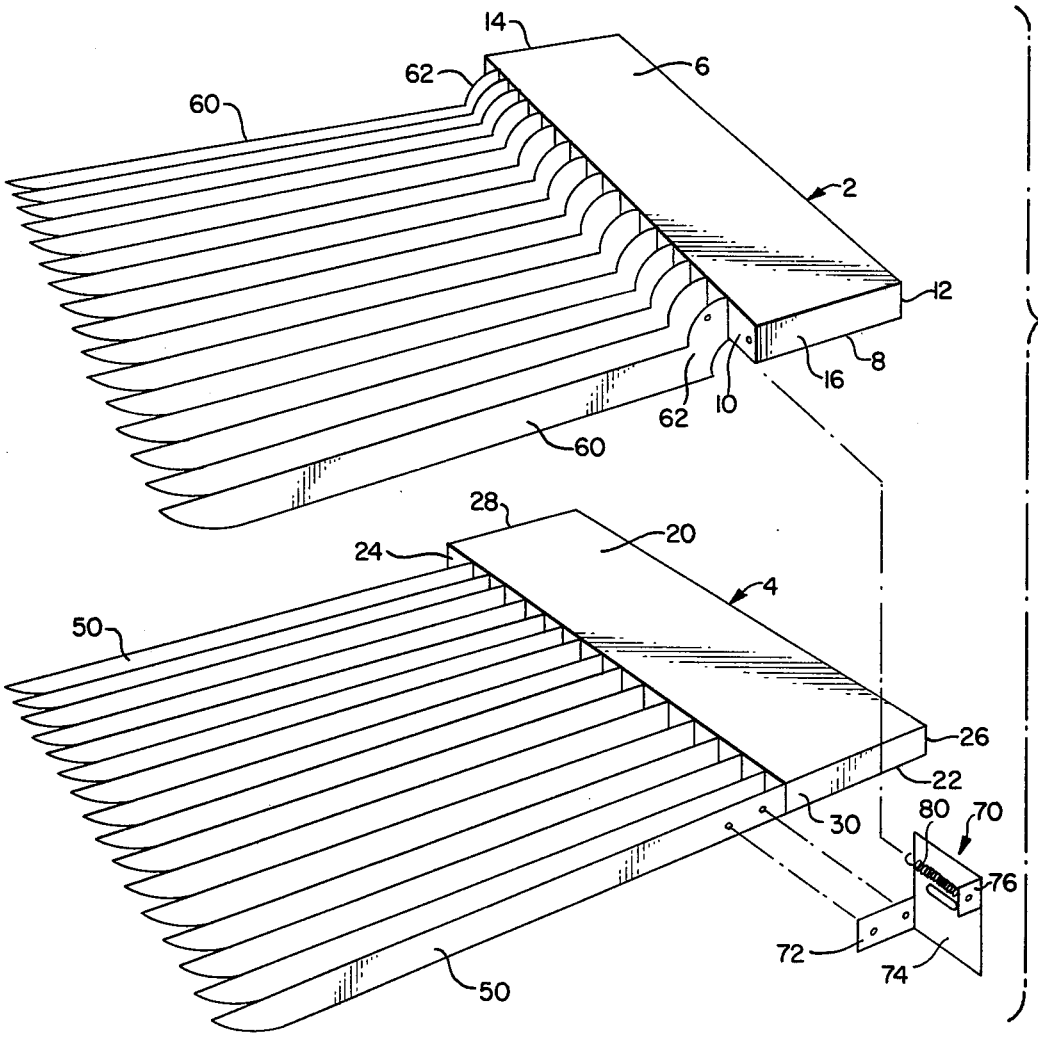
FIG. 1.
FIG. 2.
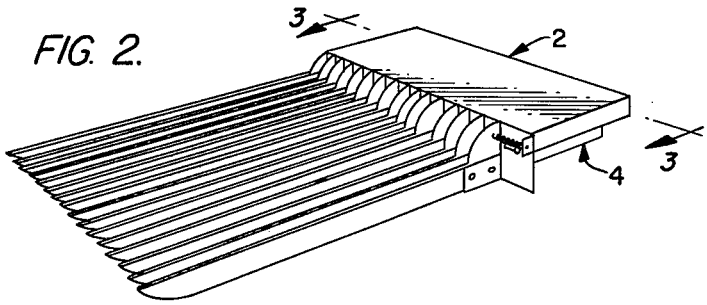
FIG. 3.
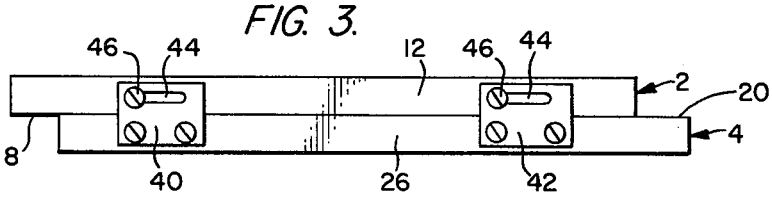

INSTRUMENT FOR USE IN HAIR CUTTING

SUMMARY OF THE INVENTION

The invention provides a comb-like device comprising two backing members which are held in surface-to-surface sliding engagement and from which two sets of parallel teeth extend which are positioned in alternate relation in the same plane, the teeth of one set being normally held in engagement with those of the other set by resilient means, manually operable means being provided for moving the teeth out of mutual engagement against the force of the resilient means to permit the hair to be introduced between the teeth, after which the resilient means are released to engage and hold the hair.

DESCRIPTION OF THE DRAWINGS

FIG. 1 is an exploded view of parts of the device, shown in their operative relations;

FIG. 2 is a perspective view of the assembled device, and

FIG. 3 is an elevational view of the back of the device.

DESCRIPTION OF THE INVENTION

The preferred form of the device provided by the invention comprises two preferably elongated rectangular upper and lower backing members 2, 4, each of which is also preferably rectangular in cross sectional shape. The upper backing member 2 has upper and lower surfaces 6, 8, front and rear longitudinal side edges 10, 12 and ends 14, 16, while the lower backing member 4 has upper and lower surfaces 20, 22, front and rear longitudinal side edges 24, 26 and ends 28, 30. The two backing members are positioned in superposed relation with the lower surface 8 of upper member 2 in surface-to-surface longitudinal sliding engagement with the upper surface 20 of lower member 4.

Means are provided by the invention for holding the two backing members together and maintaining them in relative sliding relation, and such means comprise two flat plates 40, 42 which are connected in longitudinally spaced relation to the rear side edge 26 of lower backing member 4 and extend upwardly thereform over the rear side edge 12 of the upper backing member 2. In its upper part, where it overlaps backing member 2, each plate is provided with a slot 44 which extends longitudinally of the backing members and receives a headed screw 46 carried by the upper backing member, and it will be apparent that by these means the two backing members are connected together and to permit longitudinal sliding movement of the upper member 2 over and with respect to the lower member 4 to the extent of the equal lengths of slots 44.

Each of the backing members is provided with teeth, thus forming two comb-like members. The lower backing member 4 is provided with a plurality of elongated teeth 50 which are parallel and extend outwardly from front edge 24 of the backing member at right angles to the length of the backing member. Each of the teeth is preferably flat in cross sectional shape with its major dimension in the upper-lower direction of the instrument, and the upper and lower edges of the teeth are preferably in the same plane, respectively, as the upper and lower surfaces 20, 22 of the lower backing member.

The upper backing member 2 is provided with a plurality of elongated teeth 60 which extend outwardly from the front edge 10 of the backing member at right angles thereto, each of the teeth being flat in cross sectional shape with its major dimension in the upper-lower direction of the instrument. Each of these teeth is positioned lengthwise of its connected backing member 2 so that it lies between two of the teeth 50 of the lower comb member, and each tooth is connected to the backing member 2 by a section 62 of the tooth which is curved toward the lower backing member 4 whereby the teeth of the upper and lower comb-like members are alternately positioned along the length of the instrument with their upper surfaces in the same plane and their lower surfaces in the same plane. The spacing of the teeth of both the upper and lower comb-like member is such that substantial relative movement between the teeth 50 and 60 of the upper and lower comb-like members is permitted as the two backing members are longitudinally moved with respect to each other.

The construction and relation of the parts is such that in their normal position the upper backing member 2 is displaced to the left of the lower backing member 4, as viewed from the rear as in FIG. 3, with the slots and screws 44, 46 positioned to permit the upper member to be moved to the right. In this position the teeth 50, 60 of the lower and upper comb-like members are in side-by-side surface engagement.

Means are provided by the invention for normally maintaining the teeth of the two comb-like members in side-by-side engagement, and such means comprises a unitary supporting member 70 which is preferably formed of rigid sheet material and comprises a first flat part 72 which is connected in surface-to-surface relation to the end surface 30 of the lower backing member 4, a second flat part 74 formed integrally with the first and extending outwardly from the end surfaces 16, 30 of the two backing members, and a third flat part 76 formed integrally with the first and second parts and extending from the second part in parallelism to the first part, so that the three parts from a U-shaped member with the third part spaced outwardly from and horizontally aligned with the upper backing member 2. An extension spring 80 is connected at its one end to part 76 of the supporting member 70 and at its other end to upper backing member 2, preferably through one of the teeth 60 as shown in FIG. 1, and thereby constantly urges the teeth 50, 60 into side-by-side surface engagement, in which condition the upper backing member 2 is displaced longitudinally of the lower backing member 4 as shown in FIG. 3.

In the use of the device the operator first manually moves the upper backing member against the force of the spring to open the teeth, then moves the instrument through the hair with the lower planar surface of the teeth on or just above the scalp, then raises the instrument through the hair until the upper planar surface of the teeth is at the level at which he wishes to cut the hair, then releases the upper backing member allowing the spring to move the teeth into engagement with the hair held between them, and then cuts the hair using the upper planar surface of the teeth as a guide for the scissors.

I claim:

1. A hand held device for use in holding the hair during a hair cutting proceduce, comprising two elongated backing members positioned in surface-to-surface longitudinal sliding engagement, a plurality of spaced parallel teeth extending from each backing member in a direction transverse to the longitudinal lengths thereof, the teeth of the respective backing members being alternately positioned and all teeth lying in substantially the same plane, resilient means constantly urging the teeth of one of the backing members into engagement with those of the other backing member, and means for separating the teeth against the force of the resilient means.

2. The device according to claim 1, in which the teeth are flat in cross sectional shape and the flat sides are opposite each other.

3. The device according to claim 1, in which a bracket is mounted on one of the backing members and a tension spring extends from the bracket to the other backing member.

* * * * *

UNITED STATES PATENT AND TRADEMARK OFFICE

CERTIFICATE OF CORRECTION

PATENT NO. : 4,230,134

DATED : October 28, 1980

INVENTOR(S) : Edwin C. Perez

It is certified that error appears in the above–identified patent and that said Letters Patent are hereby corrected as shown below:

On the title page, Item /76/ "Edwin C. Pérez" should read -- Edwin Crespo --.

Signed and Sealed this

First Day of September 1981

[SEAL]

*Attest:*

GERALD J. MOSSINGHOFF

*Attesting Officer*

*Commissioner of Patents and Trademarks*